US006428184B1

(12) United States Patent
Huang

(10) Patent No.: US 6,428,184 B1
(45) Date of Patent: Aug. 6, 2002

(54) INNER-TYPE CONNECTING STRUCTURE OF A BULB ASSEMBLY

(76) Inventor: Ming Hsien Huang, No. 2, Lane 65 Cherng Gong Road, Hsin Chu (TW)

( * ) Notice: Subject to any disclaimer, the term of this patent is extended or adjusted under 35 U.S.C. 154(b) by 0 days.

(21) Appl. No.: 09/776,717

(22) Filed: Feb. 6, 2001

(51) Int. Cl.[7] ..... H01R 33/00

(52) U.S. Cl. ..... 362/226; 362/249; 362/252; 362/396; 439/574; 439/699.1; 439/699.2

(58) Field of Search ..... 362/396, 439, 362/249, 252, 226, 806, 353; 439/574, 449, 669.1, 669.2, 602, 611

(56) References Cited

U.S. PATENT DOCUMENTS 6,305,822 B1 * 10/2001 Lin ..... 362/249
6,341,881 B1 * 1/2002 Huang ..... 362/226

* cited by examiner

*Primary Examiner*—Sandra O'Shea
*Assistant Examiner*—John Anthony Ward
(74) *Attorney, Agent, or Firm*—Rosenberg, Klein & Lee

(57) ABSTRACT

The present invention relates to an inner-type connecting structure of a bulb assembly which includes a bulb holder having a pair of side connecting slices with inner hook at the end. A pair of solts are provided on the supporting object for engaging with the slices. So the bulb assembly is fixed and positioned, meanwhile the engagement between the bulb holder and the supporting object is firm and secure.

1 Claim, 6 Drawing Sheets

INNER-TYPE CONNECTING STRUCTURE OF A BULB ASSEMBLY

BACKGROUND OF THE INVENTION

There are different connecting structures as shown in FIGS. 1 and 2, for fixing a bulb assembly on a supporting object. In FIG. 1, a pair of outer-type connecting slices (11) are provided on a side of the bulb holder (1) to be engaged with an aperture (13) of a supporting object (12). In FIG. 2, a ring (2) having a pair of outer-type connecting slices (21) is provided around the bulb holder (1). The connecting slices (21) are engaged within an aperture (31) on a supporting object (3) and then the bulb (4) on the bulb holder (1) is fixed on the supporting object for decorative purpose. The above said connecting structure is without stable connection and is very possible to be loosed when the bulb assembly is collided in accident.

Accordingly, the primary object of the invention is to provide an inner-type connecting structure of a bulb assembly to fix the bulb on a supporting object firmly and to increase the strength of engagement. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
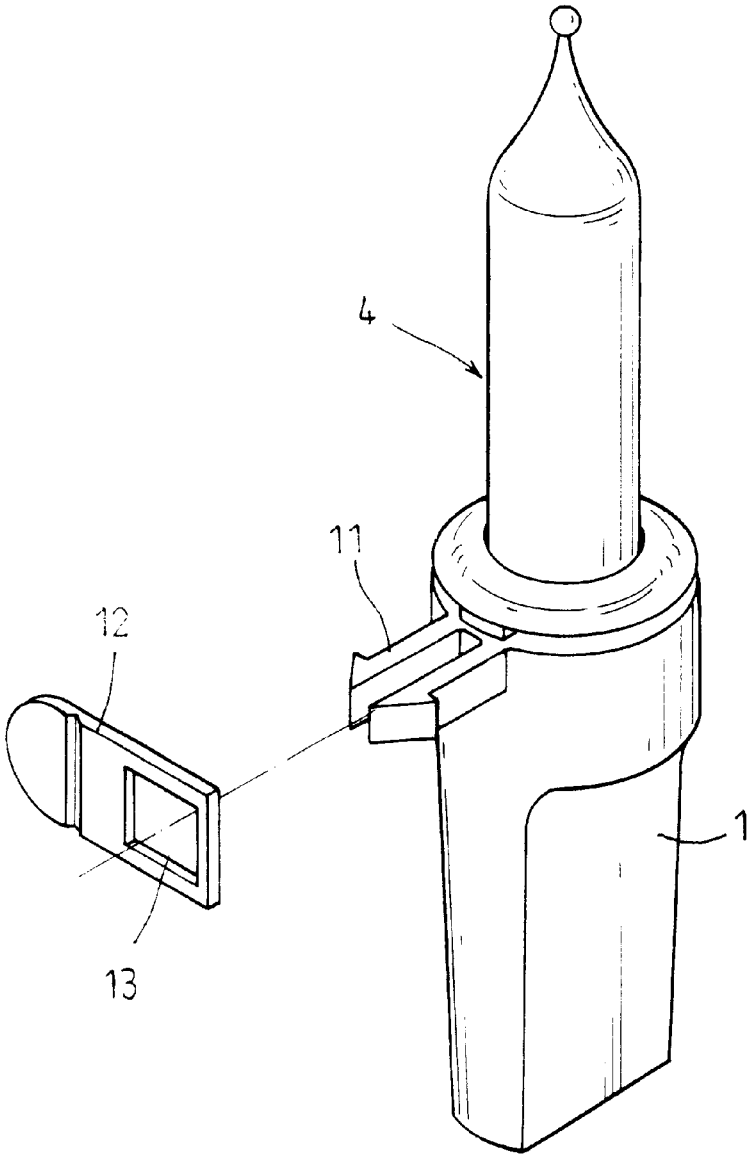
FIG. 1 (prior art)
FIG. 1 is a perspective view showing a bulb assembly to be engaged with a supporting object of a prior art structure.
Figure 2:
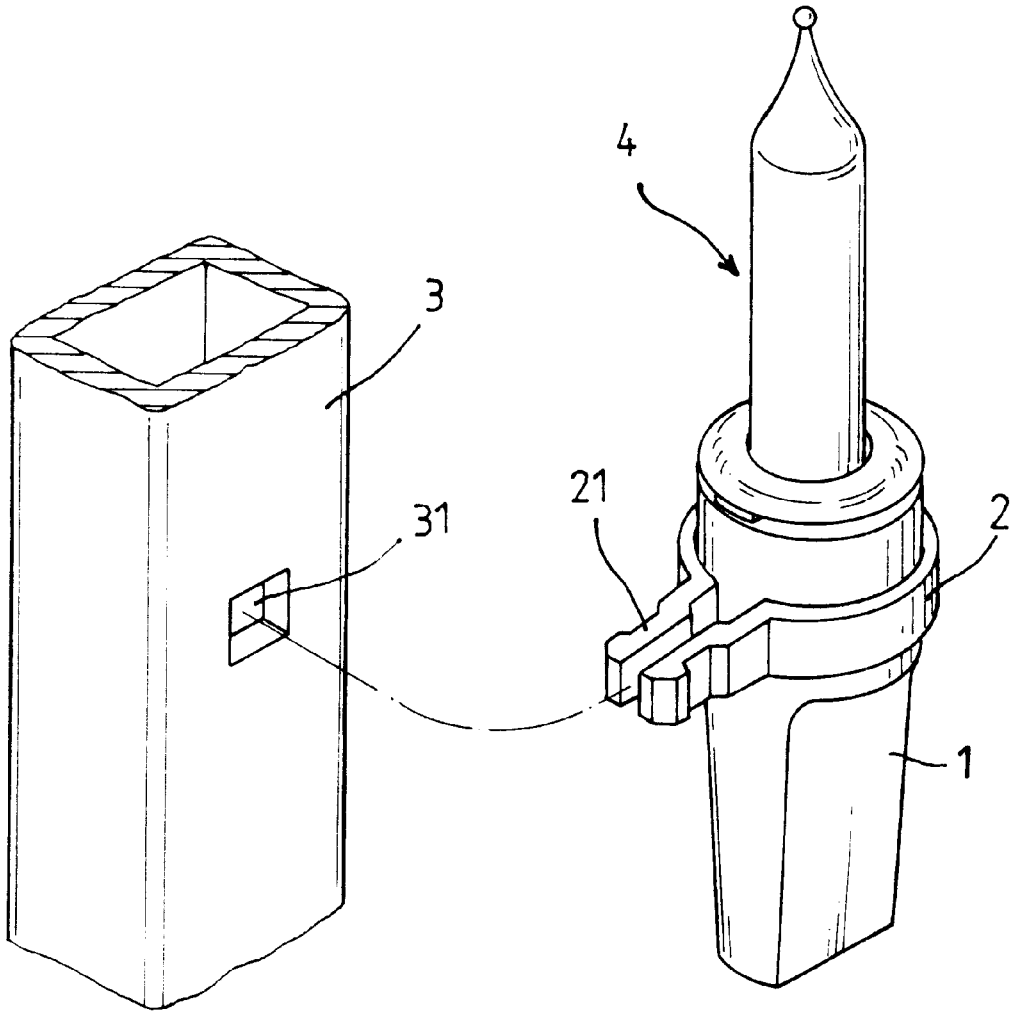
FIG. 2 (prior art)
FIG. 2 is a perspective view showing a bulb assembly to be engaged with a supporting object of another prior art structure.
Figure 3:
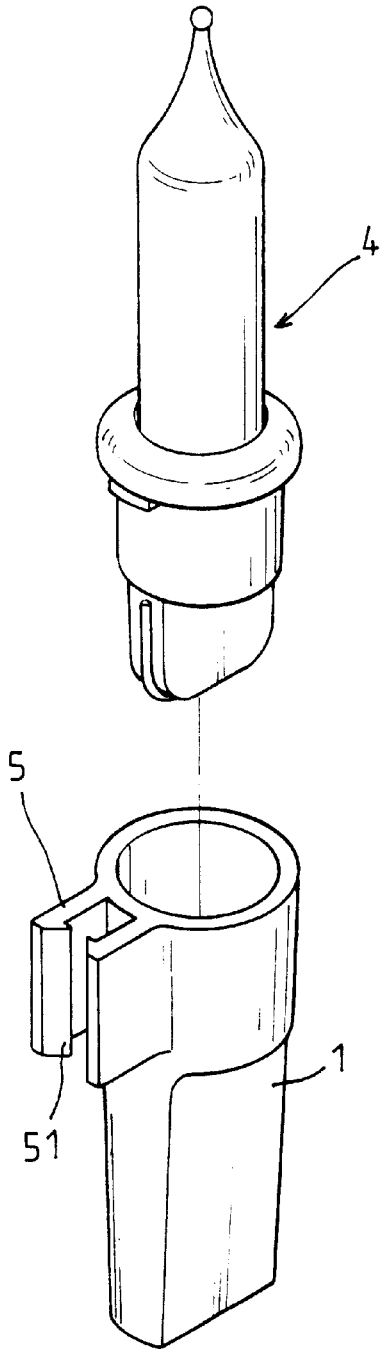
FIG. 3 is an exploded perspective view showing a bulb assembly according to the present invention.
Figure 4:
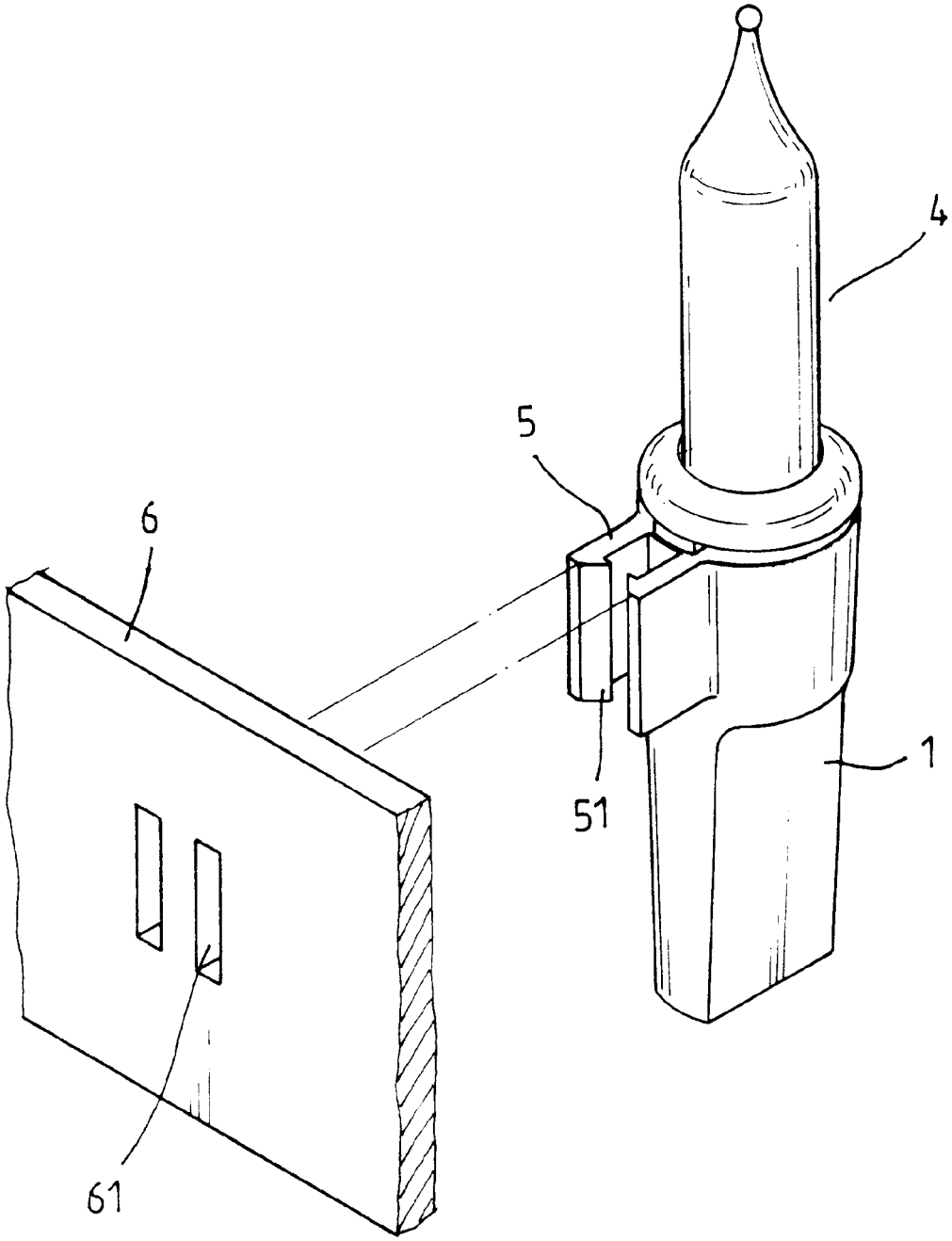
FIG. 4 is a perspective view showing the bulb assembly to be engaged with a supporting object according to the present invention.
Figure 5:
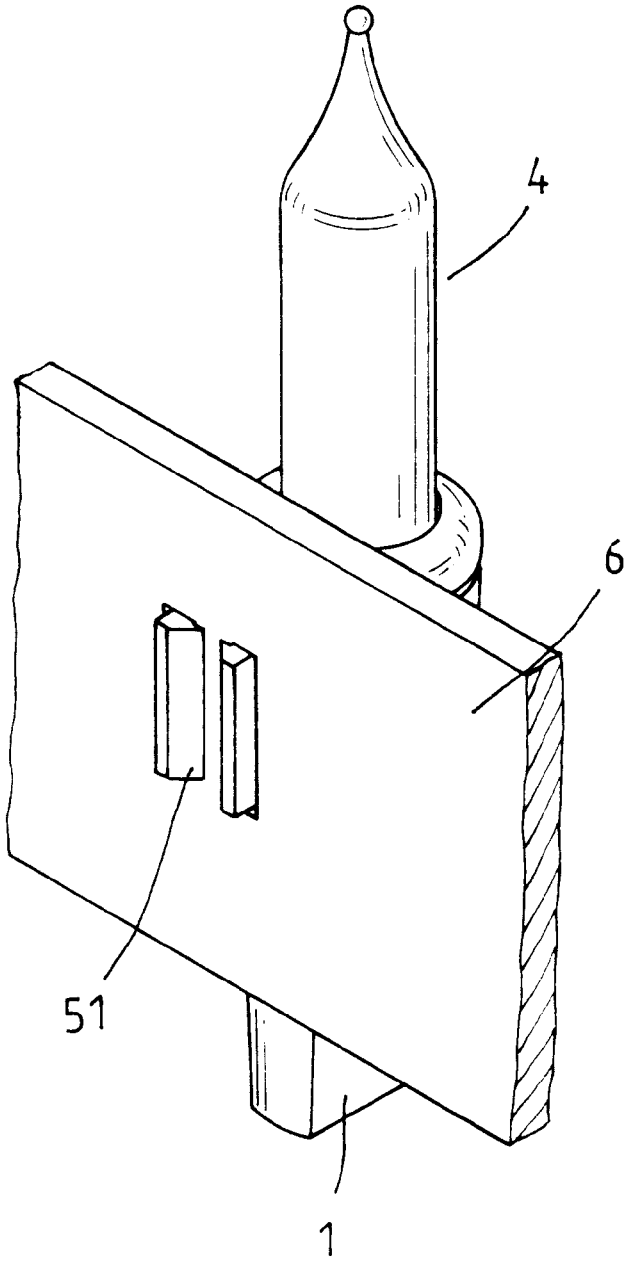
FIG. 5 is an assembled view of FIG. 4.

Referring to the FIGS. 3 to 5, the present invention includes a bulb holder (1) with a bulb assembly (4) thereon. A pair of inner-type connecting slices (5) are provided on a side of the bulb holder (1) and each of the slices (5) has an inner hook (51) at its end. The supporting object (6) is provided with two slots (61) which are related to the two slices (51). So it will be very easy to insert the slices (51) into the slots (61) to obtain a secure connection and the bulb assembly (4) is positioned at the same time.

Figure 6:
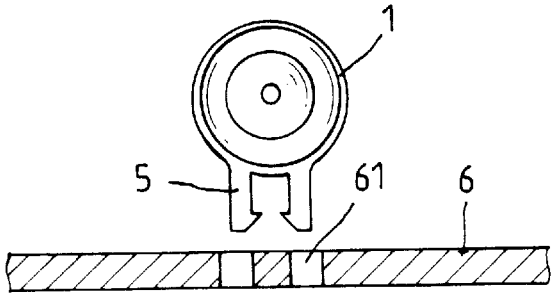
FIGS. 6–8 are plan views showing the engaging movements as being assembled of the connecting slices with the supporting object.
Figure 7:
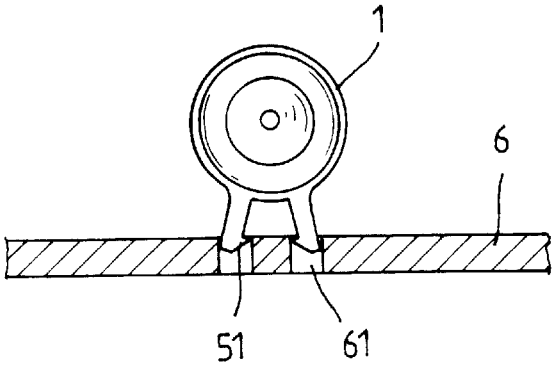
Figure 8:
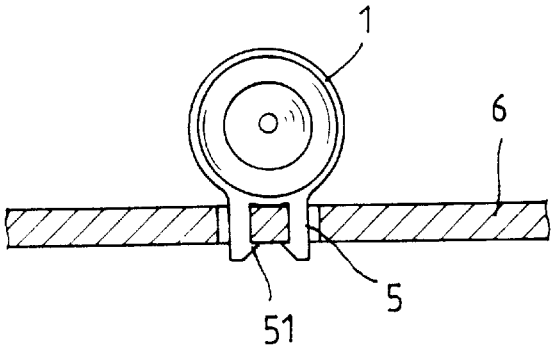

As shown in FIGS. 6 to 8, the inner-type connecting slices (51) are made of plastic material with flexibility. When the slice (51) is inserted into the slot (61), it can be bent outward slightly, as in FIG. 7. When the engagement is completed as in FIG. 8, the slice (5) is recovered and the inner hook (51) will provide a stable connection. Due to the hook (51) in provided inward, the engagement will be firm and secure between the holder (1) and the supporting object (6) that prevents from separation when it is collided in accident.

The improved structure of the present invention is obviously novel and effective. Thus it has excellent practical value in the field. Evidently the invention has the essence of a patent. We hereby apply for a patent grant.

What is claimed is:

1. A connecting structure of a light bulb assembly, comprising:

a support member having a planar surface with a pair of spaced apart slotted openings formed therethrough; and a bulb holder having a pair of slices integrally formed on a side thereof and extending outwardly therefrom, said pair of slices being disposed in spaced relationship in respective correspondence with said pair of slotted openings, each of said pair of slices having a hook formed on a distal end thereof, each said hook being formed on an inner side of a corresponding one of said slices and extending toward said hook of said other of said pair of slices, said pair of slices being respectively inserted into said pair of slotted openings and said hooks thereof engaging a rear surface of said support member to thereby secure said bulb holder to said support member.

* * * * *